US005724023A

United States Patent [19]

Takahashi et al.

[11] Patent Number: 5,724,023

[45] Date of Patent: Mar. 3, 1998

[54] SETTING DEVICE FOR FIRE ALARM SYSTEM

[75] Inventors: Keiichi Takahashi; Kazuki Takumi, both of Tokyo, Japan

[73] Assignee: Nohmi Bosai Ltd., Tokyo, Japan

[21] Appl. No.: 412,155

[22] Filed: Mar. 28, 1995

[30] Foreign Application Priority Data

Mar. 30, 1994 [JP] Japan ..... 6-061763

[51] Int. Cl.[6] ..... G08B 29/00

[52] U.S. Cl. ..... 340/516; 340/505; 340/514; 340/588

[58] Field of Search ..... 340/505, 506, 340/516, 514, 588, 589, 511, 518, 825.06, 825.07

[56] References Cited

U.S. PATENT DOCUMENTS

| | | | |
|---|---|---|---|
| 3,921,139 | 11/1975 | Hardesty, Jr. et al. | 340/514 |
| 4,329,643 | 5/1982 | Neumann et al. | 340/514 |
| 4,581,606 | 4/1986 | Mallory | 340/539 |
| 4,658,243 | 4/1987 | Kimura et al. | 340/505 |
| 4,725,819 | 2/1988 | Sasaki et al. | 340/511 |
| 4,988,977 | 1/1991 | Payne et al. | 340/514 |
| 4,988,988 | 1/1991 | Kimura | 340/825.06 |

OTHER PUBLICATIONS

Patent Abstracts of Japan, vol. 010, No. 291, (M-522), 3 Oct. 1986.

Patent Abstracts of Japan, vol. 18, No. 103, (P-1696), 18 Feb. 1994.

*Primary Examiner*—Donnie L. Crosland
*Attorney, Agent, or Firm*—Wenderoth, Lind & Ponack

[57] ABSTRACT

A portable fire alarm system setting device allows easy confirmation of information such as address information set in a storage element which cannot be seen visually from the outside of a terminal device, for example, a fire detector, and also allows the set information to be changed when necessary. The setting device for the fire alarm system comprises bases 33 and 34 for transmitting power and information signals regarding, for example, an address to the fire detector, the bases having removably connected thereto fire detectors 20 and 21 for the fire alarm system; a microcomputer 5 having a confirmation mode and a setting mode for controlling the sending and receiving of, for example, address information signals to and from the fire detector through transmission circuits 10 and 11; an indicator section 8 connected to the microcomputer 5 for indicating the fire detector address; and an operation section 7 used to send out an address as operation information to the fire detector.

15 Claims, 10 Drawing Sheets

20 : COMMON-TYPE FIRE DETECTOR
21 : SMALL FIRE DETECTOR
30 : ADDRESS CONFIRMING DEVICE

36 : OPERATION INDICATOR SECTION
37 : POWER KEY
38 : EXECUTION KEY
39~41 : DIGIT KEY
42~45 : LED

SETTING DEVICE FOR FIRE ALARM SYSTEM

BACKGROUND OF THE INVENTION

1. Field of the Invention

The present invention relates to a setting device for a fire alarm system, and, more particularly, to a setting device for a fire alarm system excellent for use, in particular, in setting and confirming, for example, the address of a terminal device such as a fire detector.

2. Description of the Related Art

Hitherto, in a so-called R-type fire alarm system, a coded signal has been sent to and received from a receiving section such as a fire receiver and terminal devices, to perform fire monitoring and maintain the normal condition of the system.

In a terminal device, for example, a fire detector used in such a fire alarm system, data regarding its type, address, etc. are stored in a storage means of a microcomputer such as an EEPROM. The receiving section specifies a terminal device by a call signal based on the address to send, for example, information regarding condition changes and control commands.

Therefore, in conventional fire alarm system equipment, address data or the like which is set in the terminal device cannot be externally verified even when it is properly set in the storage means such as an EEPROM. For example, in the place where the fire alarm system is installed, address data or the like set in the terminal device cannot be easily confirmed, thereby making it very difficult to install the terminal device.

There are problems even if the data is visually confirmable with, for example, a dip switch. For example, it is impossible to verify whether or not the control means, such as a microcomputer of the terminal device, has correctly recognized the data. In addition, it is impossible to change erroneous address data setting or duplicate setting of the terminal device. Further, the user may change the address data inadvertently.

SUMMARY OF THE INVENTION

Accordingly, in order to overcome the above problems, an object of the present invention is to provide a setting device for a fire alarm system in which address data or the like, set in a storage means which cannot be visually observed externally of, for example, the terminal device, can be easily verified, and set data can be changed when necessary.

According to a first aspect of the invention, there is provided a setting device for a fire alarm system comprising a terminal device connecting section removably connected to terminal devices of the fire alarm system for transmitting power supply and information signals to the terminal devices. A control means is connected to the terminal device connecting section for sending and receiving information signals to and from the terminal devices through a transmission circuit. An indicator section is connected to the control means for indicating at least information regarding the terminal devices.

With such a construction, address information or the like set in the terminal device can be properly and easily verified outside of the terminal device, which allows more effective operation of the device. In addition, even in cases where the data is visually verifiable with, for example, a dip switch, it is possible to verify whether the terminal device has recognized the data correctly, thereby allowing easier maintenance of the terminal device.

In a second aspect of the invention, there is provided a setting device for a fire alarm system further comprising an operation section connected to the control means for inputting desired information of the terminal devices, wherein the control means generates a setting command to the terminal device in accordance with the desired information from the operation section.

With this construction, for example, it is possible to correct an erroneous setting and avoid duplicate setting of address information to the terminal device.

In a third aspect of the invention, there is provided a setting device for a fire alarm system wherein a means distinguishes between a confirmation mode in which an indicator section indicates information received from terminal devices and a setting mode in which a setting command is sent to set information input from the operation section at the terminal devices upon start-up of the system.

With such a construction, the confirmation mode allows even a user inexperienced in handling the terminal device, for example, a fire detector, to effectively and accurately confirm address information or the like set in the terminal device, because he does not have to turn on the power supply of the device each time the terminal device is replaced to confirm the data. In addition, since a user, inexperienced in handling the terminal device, cannot change the information of the terminal device due to carelessness, it is safe from the viewpoint of terminal device control, so that it is made more reliable with enhanced quality.

The setting mode allows a user who is relatively used to handling the terminal device, for example, a fire detector, to efficiently and correctly set and confirm address data or the like of the terminal device because he does not have to turn on the power supply of the device each time the terminal device is replaced for setting and confirming the data.

In a fourth aspect of the invention, there is provided a setting device for a fire alarm system wherein a transmitting means comprises a plurality of transmission circuits which can be selectively switched in accordance with various transmission modes of terminal devices, and wherein a control means switches the plurality of transmission circuits when necessary.

With such a construction, even when terminal device in different transmission modes are used, they can be matched for use.

Even for differently shaped terminal devices, the transmission mode of the terminal device can be automatically selected so as to allow immediate setting and confirmation of address information or the like of the terminal device.

In a fifth aspect of the invention, there is provided a setting device for a fire alarm system, wherein the control means generates call commands of each transmission to the terminal devices to perform successive transmission based on the transmission modes of the terminal device giving a response.

With such a construction, it is possible to confirm the transmission mode of the terminal device responding to the command and to automatically select the transmission mode. When successive transmissions based on the transmission mode of the terminal device giving a response are performed, reliable setting and confirmation of address information or the like of the terminal device can be realized even when the transmission mode of the terminal device is not known.

In a sixth aspect of the invention, there is provided a setting device for a fire alarm system, wherein the control means sends out all call commands to the terminal device to perform time sharing transmissions based on all transmission modes of the one terminal device.

With such a construction, transmission modes do not need to be selected, so that erroneous selection of transmission modes will not occur.

In a seventh aspect of the invention, there is provided a setting device for a fire alarm system, wherein the indicator section has a plurality of indicating elements in correspondence with required numbers set according to digits to be indicated, wherein which information regarding the terminal device is indicated by the indicator elements which are lit one for each digit.

With such a construction, an indicating element is constantly lit in accordance for each digit to indicate information regarding a terminal device, so that power consumption is reduced as compared to conventional systems.

In an eighth aspect of the invention, there is provided a setting device for a fire alarm system wherein a terminal device connecting section usually has a first base to which is removably and electrically connectable a usual terminal device, and a second base embedded at an inner side of the first base, to which a second base is removably and electrically connectable to a smaller and different terminal device.

With such a construction, a usual terminal device, for example, a typical fire detector, and a smaller and different terminal device, such as a small fire detector, can both be connected, which results in a smaller construction and reduced costs compared to the usual terminal device.

DESCRIPTION OF THE PREFERRED EMBODIMENTS

A description will be made below of a setting device of a fire alarm system according to an embodiment of the invention, using as an example device for setting and confirming the address of a terminal device, for example, a fire detector, with reference to the drawings.

Figure 1:
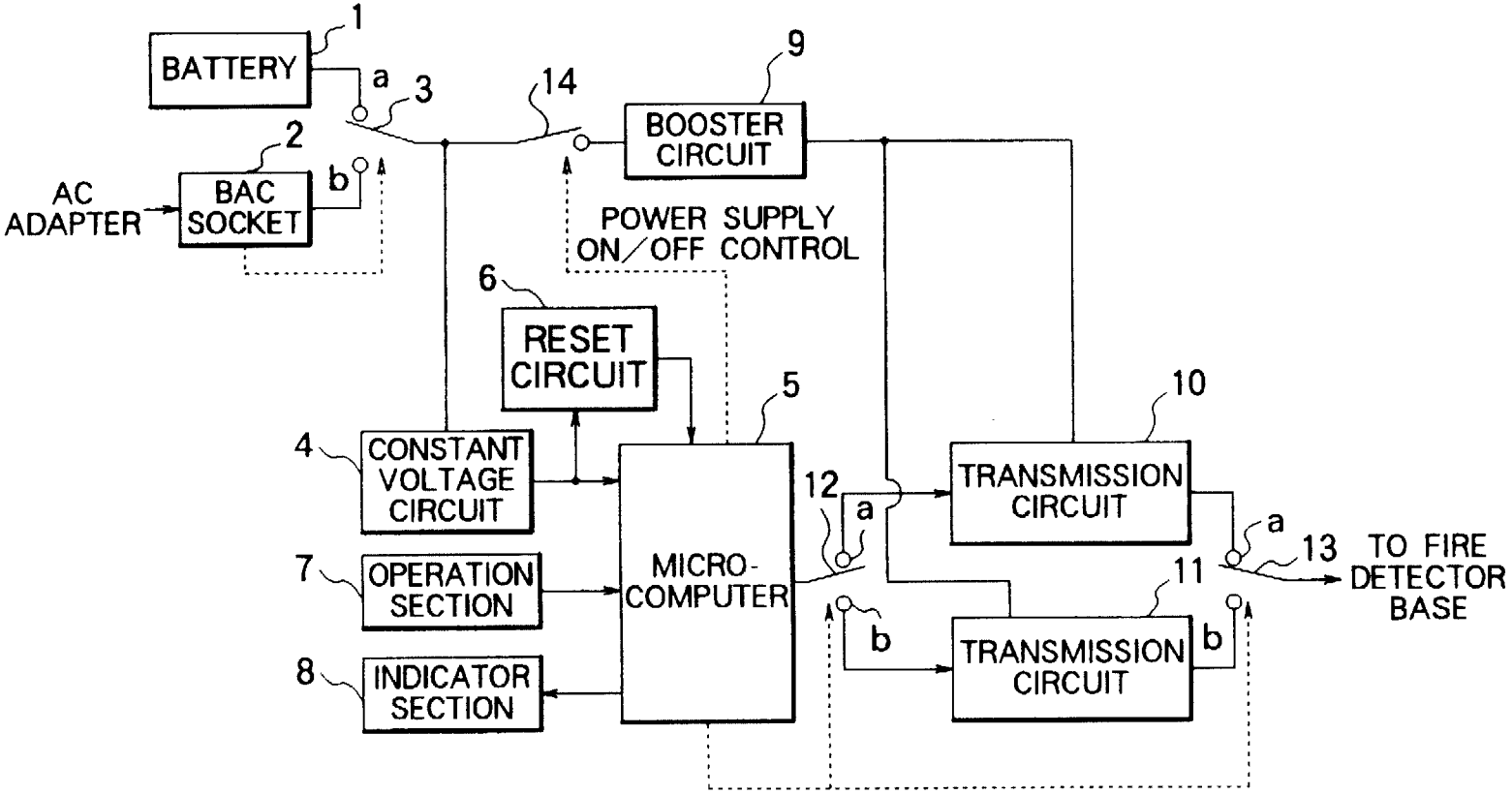
FIG. 1 is a structural view of an embodiment of the invention.

FIG. 1 is a structural view of an embodiment of the invention.

Referring to the figure, the device has a battery 1 comprising four AA dry cells and AC socket 2 connected to an AC adapter (not illustrated). When the AC adapter is inserted into a power terminal of the device, a power source change-over switch 3 moves from a contact a connected to the battery 1 to a contact b connected to the AC socket 2. The battery 1 and the AC socket 2 are examples of a means for supplying power to the device.

The device includes a constant voltage circuit 4 connected to an output end of the switch 3 for stabilizing the source voltage; a microcomputer 5 serving as control means for supplying voltage from the constant voltage circuit 4 to carry out various operations; a reset circuit 6 which resets the microcomputer 5 when power is turned on; an operation section 7 having a plurality of pushbutton switches used for sending out various operation information to the microcomputer 5; an indicator section 8 for indicating address codes or the like of the fire detector; a booster circuit 9 for raising the voltage from, for example, 6 volts to 30 volt, to allow operation of the fire detector connected to the outside; and transmission circuits 10 and 11 to which are applied increased voltage resulting from the action of the booster circuit 9 in which the transmission circuit 10 is, for example, for an analog type fire detector (in which the detection level of the fire detector is transmitted), while the transmission circuit 11 is for an on/off type fire detector (in which a fire is detected to transmit a fire signal).

The device further comprises a transmission circuit change-over switch 12 provided between the microcomputer 5 and the input sides of the transmission circuits 10 and 11; and a transmission circuit change-over switch 13 provided between the output sides of the transmission circuits 10 and 11 and a fire detector base connected to the outside. Switches 12 and 13 are constructed such that they can be simultaneously switched by means of a control signal from the microcomputer 5.

The device further comprises a switch 14 provided between the output end of the switch 3 and the booster circuit 9 adapted to be switched between the on and off states by the control signal from the microcomputer 5.

Figure 2A:
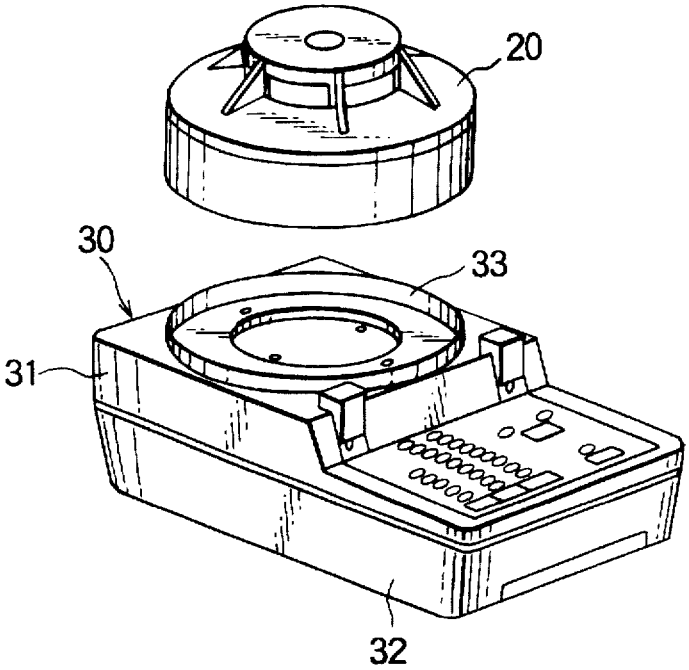
FIG. 2*a* is a perspective view of a common fire detector removed from the base in an embodiment of the invention.
Figure 2B:
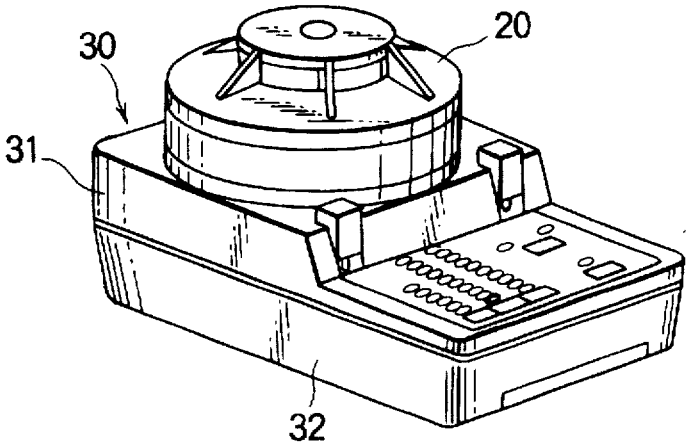
FIG. 2*b* is a perspective view of a typical fire detector mounted to a base in an embodiment of the invention.
Figure 3A:
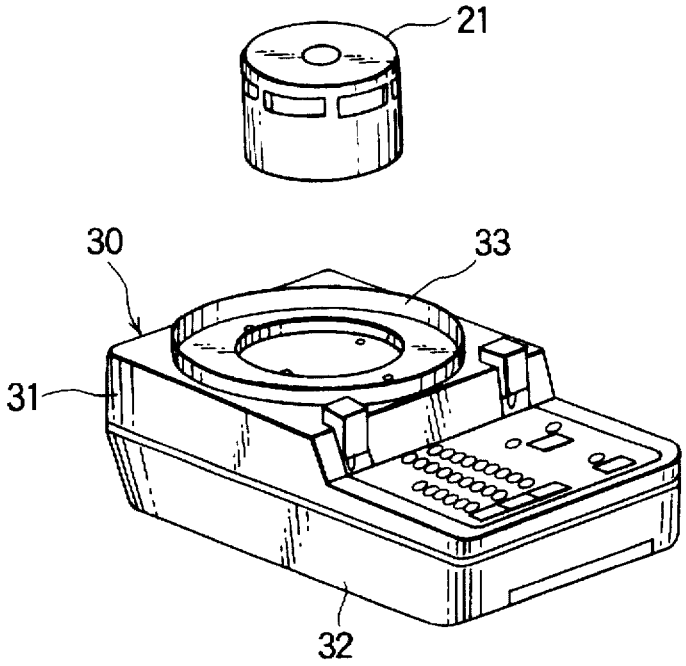
FIG. 3*a* is a perspective view of a small fire detector removed from the base in an embodiment of the invention.
Figure 3B:
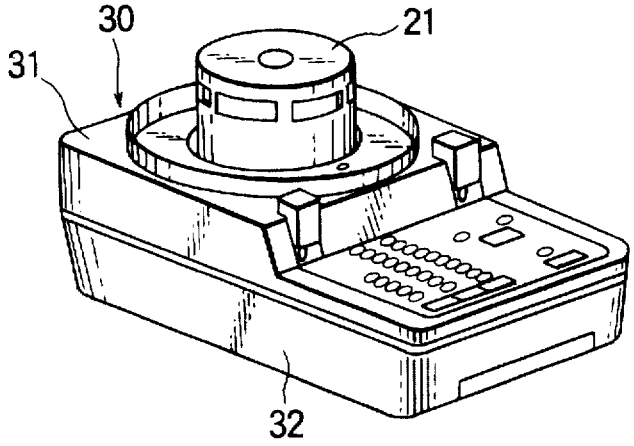
FIG. 3*b* is a perspective view of a small fire detector mounted to the base in an embodiment of the invention.

FIGS. 2*a* and 2*b* and FIGS. 3*a* and 3*b* illustrate the portable device having the above-described circuit configuration, and a fire detector which can be removably mounted thereto. FIGS. 2*a* and 2*b* illustrate, for example, a typical analog type fire detector 20 and FIGS. 3*a* and 3*b* illustrate a small on/off type fire detector 21.

The device 30 further has a housing comprising an upper case 31 and a lower case 32. A recess 33 is formed on the top side of the upper surface of the upper case 31. A common-type fire detector base 34 and a small fire detector base 35 provided at the inner side of the fixtures used for mounting the detector to the base 34, are mounted to this recess, as those shown in FIG. 4.

FIGS. 2*a* and 3*a* each illustrate a fire detector removed from the base, while FIGS. 2*b* and 3*b* each illustrate a fire detector mounted to the base.

Figure 4:
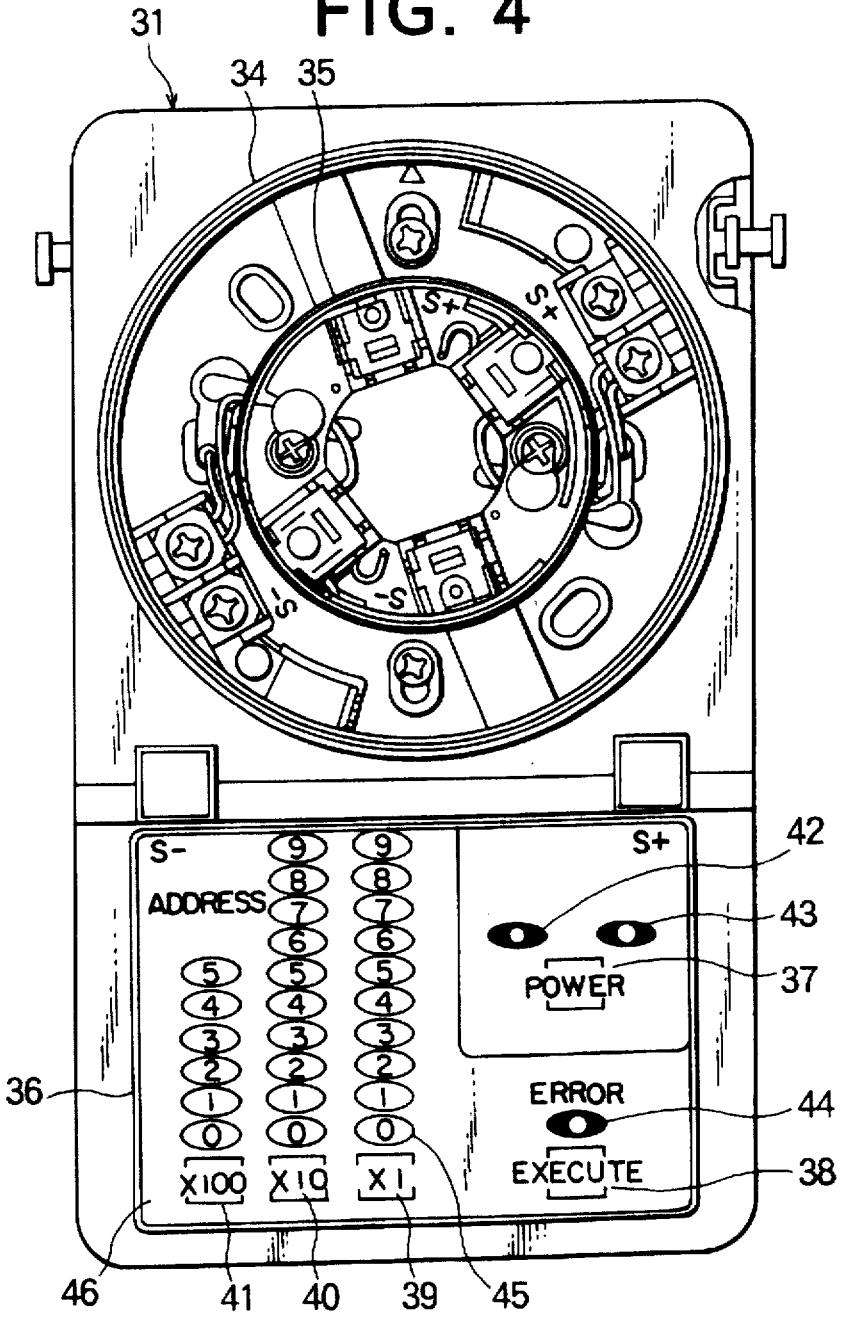
FIG. 4 is a plan view of an operation section in an embodiment of the invention.

FIG. 4 is an enlarged view of the operation section of the device 30. Referring to the figure, the device 30 includes an operation indicator section 36 having an operation section 7 and an indicator section 8 corresponding to those of FIG. 1, and a pushbutton type power key 37 which corresponds to the switch 14 of FIG. 1. The power key 37 functions as the switches 12 and 13 shown in FIG. 1. In other words, pressing the power key 37 once, for example, causes the switches 12 and 13 to be moved to a contact a, and pressing the key 37 once again causes the switches 12 and 13 to be moved to a contact b. Pressing it one more time causes the switch 14 to be placed in an off state.

The device 30 further includes a pushbutton type execution key 38 provided on the operation section 7. Pressing this key 38 completes address setting. The device 30 further includes "x 1", "x 10", and "x 100" pushbutton digit keys denoted respectively by reference numerals 39 through 41; indicator elements, for example, LEDs 42 and 43 for indicating that the analog-type fire detector transmission circuit 10 or the on/off-type fire detector transmission circuit 11 has been switched, when the switches 12 and 13 have been moved to the contact a or the contact b; indicator element, for example, LED 44 for indicating an abnormality in, for example, fire detectors; and indicator elements, for example, LEDs 45, for indicating each address value which is written onto, for example, a membrane sheet 46.

Here, as an example, the LEDs 45 corresponding to numbers 0 through 9 are disposed above the part marked "x 1" (units digit), and the LEDs 45 corresponding to numbers 0 through 9 are disposed above the part marked "x 10" (tens digit), and the LEDs 45 corresponding to numbers 0 through 5 are disposed above the part marked "x 100" (hundreds digit). With one LED constantly lit for each digit, a set of three LEDs 45 are always lit to indicate the address. For example, numbers 1 to 510 can be lit to indicate the address.

Accordingly, the desired address can be simply indicated by lighting three LEDs 45 at all times, so the power consumption can be reduced compared to conventional indicating methods. For example in the 7-segment indicating method, six indicator elements need to be lit to indicate the minimum value address "111", while 21 of them need to be lit to indicate the maximum value address "888" (actually this cannot be indicated because it falls outside the range). However, in the embodiment, only three need to be lit at all times, so that the power consumption is reduced to ½ to ⅐ that in the conventional 7-segment indicating method.

Figure 5:
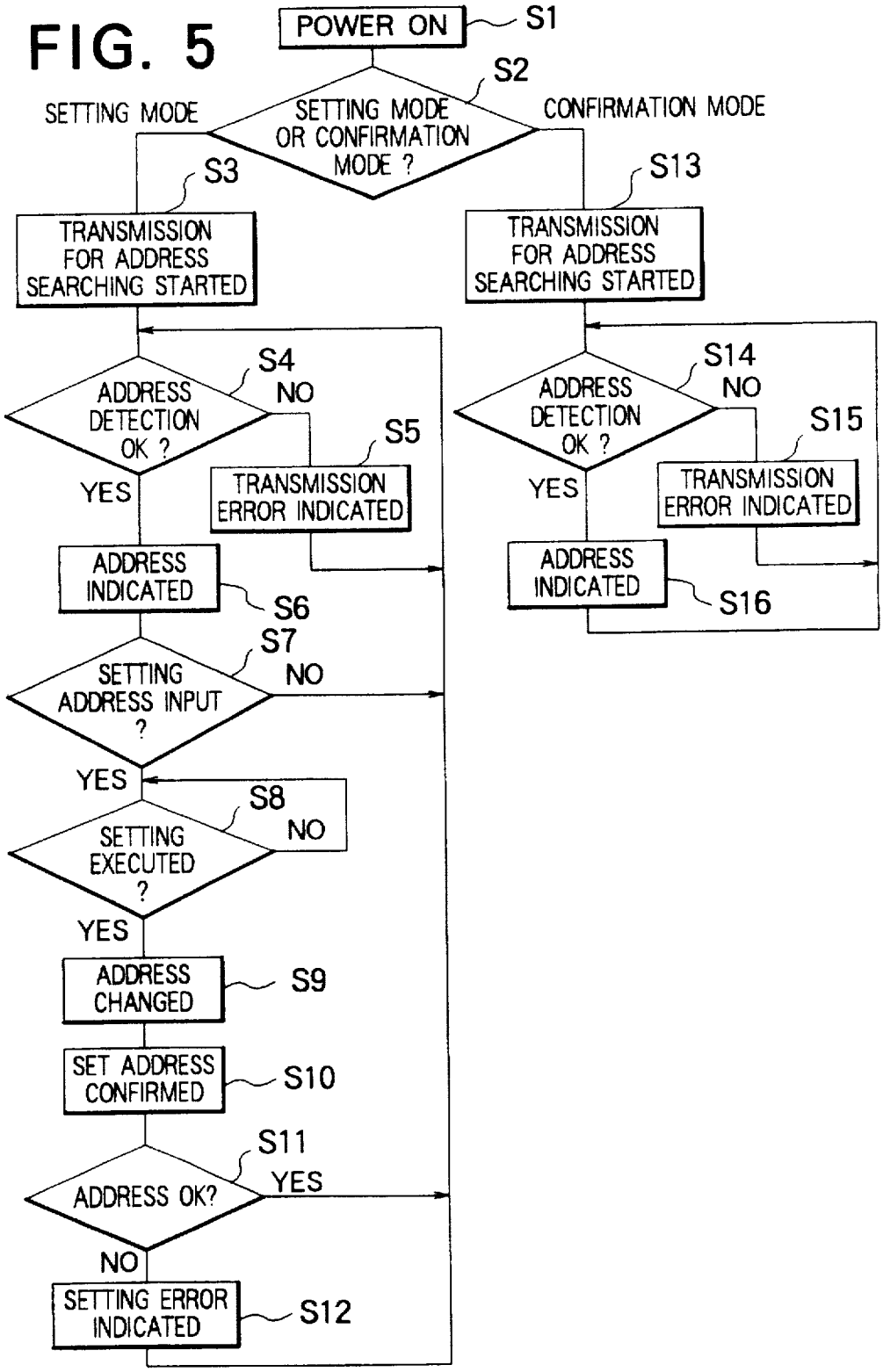
FIG. 5 is a flowchart for describing the basic operation of an embodiment of the invention.

A description will be made of the basic operation of the device of FIG. 1 with reference to FIG. 5. It is to be noted that in the description, all determinations are made in the microcomputer 5.

In Step S1, for example, the digit key 39 and the source key 37 of FIG. 4 are pressed simultaneously to cause the operation mode to be set in setting mode. In correspondence with the fire detector to be set under the control of the microcomputer 5, the switches 12 and 13 move to either the transmission circuit 10 side or the transmission circuit 11 side and, at the same time, the switch 14 closes causing the power source to be turned on. In Step S2, the microcomputer 5 determines whether the mode is address setting mode or confirmation mode. Since, in this case, the mode is in setting mode, in Step S3, transmission for searching the self address is started. A command is generated to the fire detector to cause it to send its address. This address is received by the microcomputer 5.

In Step S4, the microcomputer 5 determines whether or not the address has been properly sent back. If it has not been properly sent back, in Step S5, the occurrence of a transmission error in that, for example, the fire detector has not yet been connected or that it is broken, will be indicated by an ERROR LED 44 at the indicator section 8. In other words, the LED 44 on the operation indicator section 36 of FIG. 4 will turn on. Thereafter, with the process returned back to Step S4, the device waits for the fire detector to be properly connected or for it being replaced with a good one.

On the other hand, in Step S4, if the address from the aforementioned fire detector has been properly sent back, then, in Step S6, this address is indicated at the indicator section 8. In other words, three LEDs 45 on the operation indicator section 36 of FIG. 4 which correspond to the numbers of the address are lit.

In Step S7, the microcomputer 5 determines whether or not there has been input of the address to be set. The address input is done as follows. Digit key 39, 40, or 41 on the operation indicator section 34 of FIG. 4 is pressed. This causes the LED 45 of the lowest row to blink. Pressing it again causes the LED 45 of the second lowest row from the bottom to blink. Repeating the above procedure causes the upper row LED 45 to blink successively, so that an LED 45 for each digit blinks to input the address to be set.

If the setting address has not been input in Step S7, the process returns back to Step S4 and the above-described operation is repeated. If the setting address has been input, the process proceeds to Step S8 to determine whether or not the setting has been executed, that is whether or not an execution key 38 of FIG. 4 has been pressed.

If the execution key 38 has not been pressed, with the setting address indicated, the device waits for the execution key 38 to be pressed. If the execution key 38 has been pressed, address setting is completed. The LEDs 45 which have been blinking are now lit, so that the three LEDs 45 which correspond to the input address values are lit.

In Step S9, the set address is transmitted along with an address setting command, etc. to the corresponding fire detector to change the address stored in an internally provided storage means, for example, an EEPROM. In Step S10, this address, which has been changed and set, is sent back again for confirmation.

In Step S11, the microcomputer 5 determines whether or not the address which has been sent back from the fire detector matches the address set at the device. If they do match each other, the process returns back to Step S4 and it prepares for the setting of the next fire detector. If, in Step S10, they do not match each other, then, in Step S12, an occurrence of a setting error in which an address change could not be performed is indicated at the indicator section 8. That is, LED 44 of the operation indicator section 36 of FIG. 4 is lit. Thereafter, with the process returned back to Step S4, in Step S7, setting is executed again to change the address.

In Step S1, pressing, for example, the power key 37 alone causes an operation mode to be set in confirmation mode. In correspondence with the fire detector to be set under the control of the microcomputer 5, the switches 12 and 13 move to either the transmission circuit 10 side or to the transmission circuit 11 side, and the switch 14 closes, causing the power source to turn on. In Step S2, the microcomputer 5 determines whether the mode is the address setting mode or confirmation mode. In this case, the mode is confirmation mode, so that as in the aforementioned Steps S3 through S6, first in Step S13, transmission for address searching is started to generate a command so that the fire detector sends its self address. This address is received by the microcomputer 5.

In Step S14, the microcomputer 5 determines whether or not the address has been sent back properly. If it has not been properly sent back, in Step S15, the occurrence of a transmission error (for example, the fire detector has not yet been connected or it is broken) will be indicated at the indicator section 8. In other words, LED 44 of operation indicator section 36 of FIG. 4 will turn on. Thereafter, with the process returned back to Step S14, the device waits for the fire detector to be properly connected or for it to be replaced by a good one.

In Step S14, if the address has been properly sent back from the aforementioned fire detector, then, in Step S16, this address is indicated at the indicating section 8. In other words, three LEDs 45 of the operation indicator section of FIG. 4 which correspond to the numbers of the address are lit. Then, the process returns back to Step S14 and the device prepares for the confirmation of the next fire detector.

Accordingly, using the setting mode of Steps S1 through S12 allows the device to wait at Step S4 upon completion of address setting and confirmation of one fire detector and prepare for the address setting and confirmation of the next fire detector. Therefore, if the user is relatively used to handling fire detectors or the like, he does not have to turn on the power of the device 30 every time the fire detector is replaced. This allows him to efficiently and accurately set and confirm the address of the fire detector.

Using the confirmation mode of Steps S1 and S2, and Steps S13 through S16 allow the device 30 to wait at Step S14 upon completion of the setting and confirming of the address of a fire detector and to prepare for the address confirmation of the next fire detector. Therefore, even a user who is not used to handling a fire detector or the like will not have to turn on the power source of the device 30 every time the fire detector is replaced. This allows him to efficiently and accurately confirm the address of the fire detector.

In addition, in this case, a user who is not experienced in handling a fire detector or the like cannot carelessly change the address which has been already set, so that it is safe from the viewpoint of controlling the fire detector.

In this way, using the setting mode and confirmation mode functions allows easy and accurate outside confirmation of data regarding, for example, an address, which has been set in the storage means in the terminal device interior, which results in more efficient operability.

Even in cases where the data can be confirmed visually with, for example, a dip switch, it is possible to confirm whether or not the control means, for example, a microcomputer of a terminal device has properly recognized the data, which results in easier maintenance of the terminal device.

It becomes possible to change an erroneous setting or duplicate setting of address data of the terminal device. In addition, in confirmation mode, address data or the like previously set cannot be rewritten due to carelessness, so that a more reliable terminal device with enhanced quality is produced.

A description will be made of the operation steps to be taken when the transmission modes of, for example, fire detectors serving as terminal devices are different, with reference to FIGS. 6 through 10.

In an example of a transmission mode in a typical smallscale fire alarm system, the transmission speed is 600 bits/s, the transmission control method used is polling/selecting method, the synchronization method used is start-stop synchronization method, and the communication method is half-duplex communication method. On the other hand, in a transmission mode in a large-scale fire alarm system, the transmission speed is 2400 bits/s, the transmission control method used is cyclic polling method, the synchronization method used is start-stop synchronization method, and the communication method is half-duplex communication method. Large-scaled systems allow pre-transmission of large amounts of data.

In the embodiments below, a description will be made of the three processing methods which may be used when the transmission modes of, for example, fire detectors serving as terminal devices are different. The three methods are: the manual switching method in which the transmission mode is switched using a change-over switch; the calling selecting method, in which a plurality of calling commands are sent out in a plurality of transmission modes, with the commands responded to by the terminal device executed; and the all-signal sending method in which, when commands regarding, for example, calling commands are sent out, execution is carried out by using all transmission mode commands.

Figure 6:
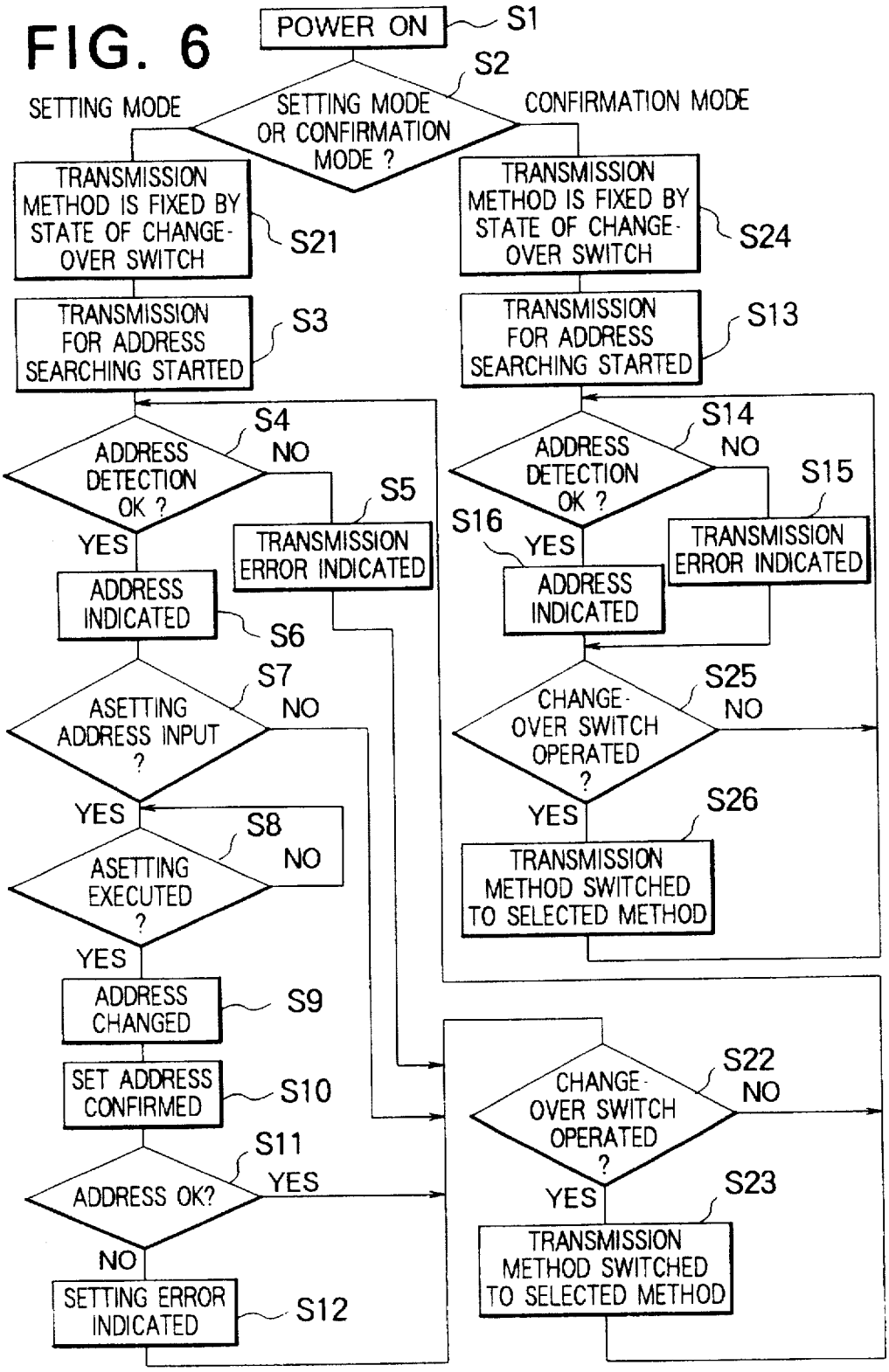
FIG. 6 is a flowchart for describing the operational steps to be performed (manual switching method) when the transmission modes of the fire detectors or the like in an embodiment of the invention are different.

A description will be made of the manual switching method with reference to FIG. 6. Here, determinations are made in the microcomputer 5. In FIG. 6, the same steps as those in Step S5 are given the same reference numerals. In Step S1, pressing simultaneously, for example, the digit key 39 and power key 37 of FIG. 4 causes the operation mode to be set in setting mode. In correspondence with the fire detector to be set under the control of microcomputer 5, the switches 12 and 13 move to either transmission circuit 10 side or transmission circuit 11 side and, at the same time, the switch 14 closes, causing the power to be turned on.

In Step S2, the microcomputer 5 determines whether the mode is address setting mode or confirmation mode. In this case, the mode is setting mode, so that, in Step S21, the transmission method is fixed by the state of the change-over switch (not illustrated). That is, for example, in setting the address of the analog type fire detector, the switches 12 and 13 are fixed to contacts a to interpose the transmission circuit 10 in a transmission system. Thereafter, in Step S3, transmission for address searching is started to generate a command to cause the fire detector to send its self address. This address is received by the microcomputer.

In Step S4, the microcomputer determines whether or not the address has been sent back properly. If it has not been properly sent, then, in Step S5, the occurrence of a transmission error (for example, the fire detector has not yet been connected or it is broken) will be indicated at the indicator section 8. In other words, LED 44 of the operation indicator section 36 of FIG. 4 will turn on. In Step S22, the microcomputer 5 determines whether or not the change-over switch has been operated. If it has not been operated, the process returns back to Step S4 and the address confirming device waits for the fire detector to be properly connected or for it to be replaced with a good one. If the switch has been operated, then, in Step S23, after switching the transmission method to that which has been selected, the process returns back to Step S4 and the same operations as described above are performed.

If, in Step S4, the address is that of the fire detector, then, in Step S6, this address is indicated at the indicator section 8. In other words, three LEDs 45 of the operation indicator section 36 of FIG. 4 which correspond to the numbers of the address are lit.

Then, in Step S7 the microcomputer 5 determines whether or not the address to be set has been input. The address is input as has been described above.

If the setting address has not been input in Step S7, the process returns back to Step S4 and the above-described operations is repeated. If the setting address has been input, the process proceeds to Step S8 where determination is made as to whether or not the setting has been executed, that is whether or not execution key 38 of FIG. 4 has been pressed.

If the execution key 38 has not been pressed, with the setting address indicated, the device waits for the execution key 38 to be pressed. If the execution key 38 has been pressed, address setting is completed. The LEDs 45 which have been blinking are now lit, so that three LEDs 45 which correspond to the input address values are lit.

In Step S9, the set address is transmitted along with address setting command, etc. to the corresponding fire detector to change the address stored in an internally provided storage means, for example, an EEPROM. In Step S10, this address, which has been changed and set, is sent back again for confirmation.

In Step S11, the microcomputer 5 determines whether or not the address which has been sent back matches the address set at the device. If they do match each other, Steps S22 and S23 are carried out, after which the process returns back to Step S4 where preparation is made for the setting of the next address detector. If they do not match each other in Step S11, then, in Step S12, the occurrence of a setting trouble is indicated at the indicator section 8. That is, the LED 44 of the operation indicator section 36 of FIG. 4 is lit. Thereafter, Steps S22 and S23 are performed, after which the process returns to Step S4.

In Step S1, pressing, for example, the power key 37 of FIG. 4 alone causes operation mode to be set in confirmation mode. In correspondence with the fire detector to be set under the control of the microcomputer 5, the switches 12 and 13 move to either transmission circuit 10 side or transmission circuit 11 side and the switch 14 is closed, causing the power to be turned on. Then, in Step S2, the microcomputer determines whether the mode is address setting mode or confirmation mode. In this case, the mode is confirmation mode, so that as in the above-described Steps S21, S3 through S5, S22, S23, and S6, first in Step S24, the transmission system is fixed by the state of the change-over switch.

That is, for example, in setting the address of the analog type fire detector, switches 12 and 13 are fixed to contacts a to interpose the transmission circuit 10 in a transmission system. Thereafter, in Step S13, transmission for address searching is started to generate a command to cause the fire detector to send its address. This address is received by the microcomputer 5.

In Step S25, the microcomputer 5 determines whether or not the change-over switch has been operated. If it has not been operated, the process returns back to Step S4 and the confirming device waits for the fire detector to be connected properly or for it to be replaced with a good one. If it has been operated, then, in Step S26 after the transmission method has been switched to the one which has been selected, the process returns back to Step S4 and the same operations as described above are performed. Thereafter, with the process returned back to Step S14, the device waits for the fire detector to be properly connected or for it to be replaced with a good one.

In Step S14, if the address is that of the fire detector, then, in Step S16, this address is indicated by the indicator section 8. That is, three LEDs 45 of the operation indicator section 36 of FIG. 4 which correspond to the numbers of the address are lit. Then, Steps S25 and s26 are carried out and the process returns back to Step S14 where preparation is made for the confirmation of the next fire detector.

The address setting of, for example, on/off type fire detectors having different transmission modes mentioned above is performed by carrying out the same operations described above with the switches 12 and 13 fixed to contact b and interposing transmission circuit 11 in transmission system.

Performing the operations according the aforementioned manual switching method and switching the transmission mode with a change-over switch allow fire detectors serving as terminal devices having different transmission modes to be used since the modes can be matched.

Figure 7:
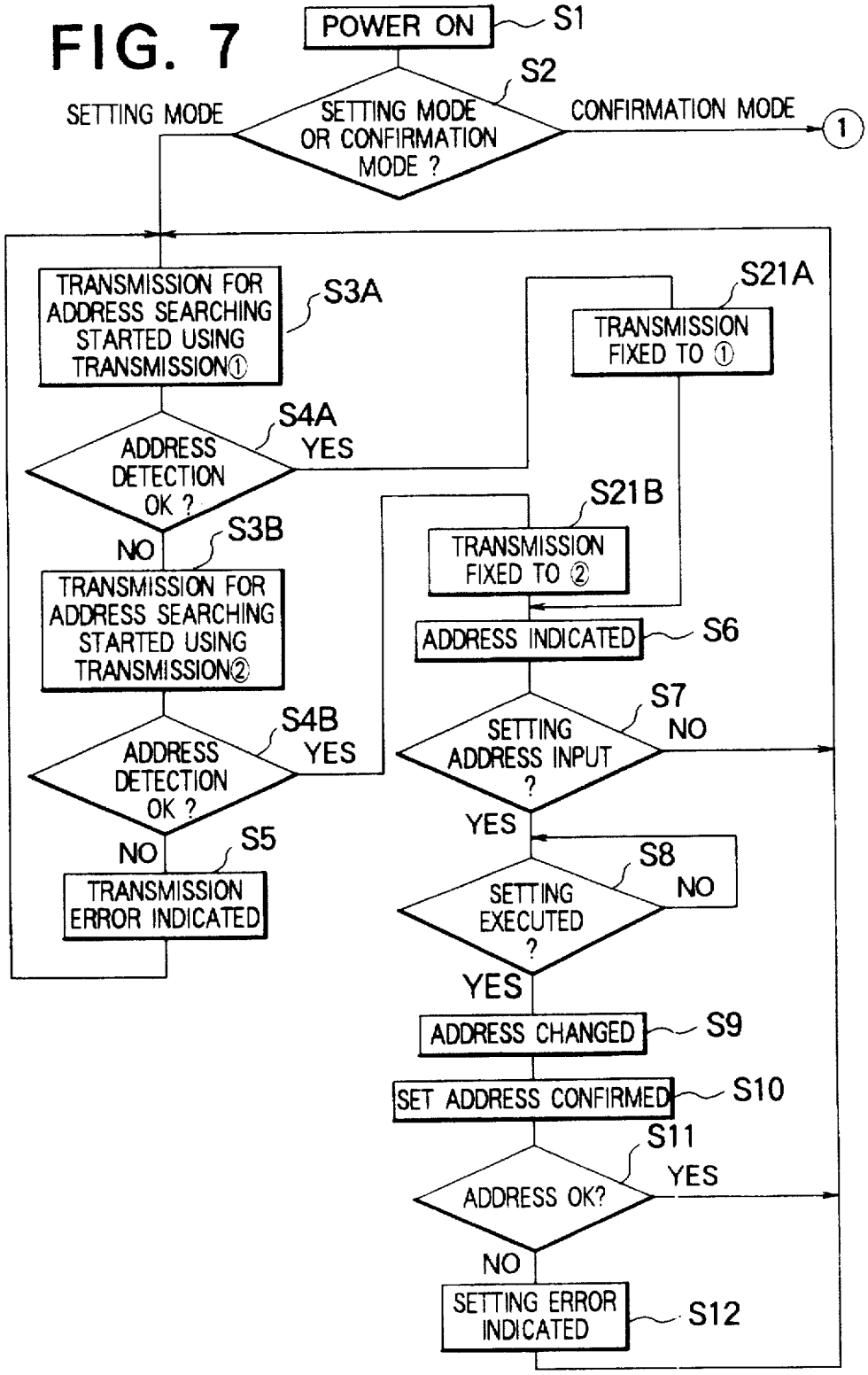
FIG. 7 is a flowchart for describing the operational steps to be performed (calling selecting method) when the transmission modes of fire detectors or the like in an embodiment of the invention are different.
Figure 8:
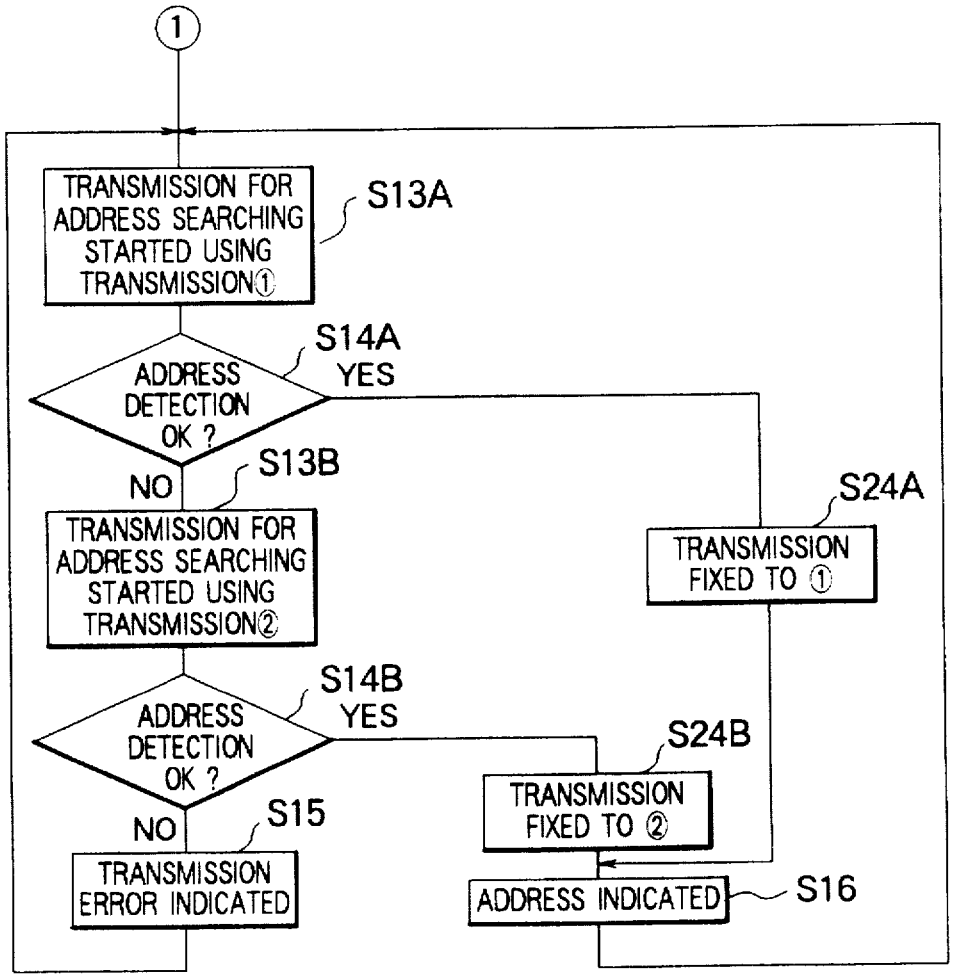
FIG. 8 is a flowchart for describing the operational steps to be performed (calling selecting method) when the transmission modes of fire detectors or the like in an embodiment of the invention are different.

A description will be made of the operations which are performed according to the calling selecting method, with reference to FIGS. 7 and 8. Here, all determinations are made in the microcomputer 5. In FIGS. 7 and 8, the processing steps which are the same as those of FIG. 5 are given the same reference numerals. In addition, a transmission ① represents transmission using the transmission circuit 10, while a transmission ② represents transmission using the transmission circuit 11.

In Step S1 of FIG. 7, pressing, for example, the digit key 39 and power key 37 of FIG. 4 causes the operation mode to be set in setting mode. In correspondence with the fire detector to be set under the control of the microcomputer 5, the switches 12 and 13 switch to either transmission circuit 10 or 11 side, and the switch 14 is closed, causing the power to turn on. Then, in Step S2, the microcomputer 5 determines whether the mode is address setting mode or confirmation mode. In this case, the mode is setting mode so that, in Step S3A, by way of the transmission ① transmission for address searching is started. A command is generated to cause the fire detector to send its address. This address is received by the microcomputer 5.

In Step S4A, the microcomputer 5 determines whether to not the address has been properly sent back. If it has not been properly sent back, then, in the same way, in Step S3B, by way of the transmission ②, transmission is started for address searching. A command is generated so that the fire detector sends its self address. The address is received by the microcomputer 5.

Thereafter, in Step S4B, the microcomputer 5 determines whether or not the address has been properly sent back. If it has not been properly sent back, then, in Step S5, an occurrence of a transmission error in that, for example, the fire detector has not yet been connected or that it is broken, is indicated by the indicator section 8. In other words, the LED 44 of the operation indicator section 36 of FIG. 4 is lit. Then, the process returns back to Step S3A.

If, in Step S4A, the address has been properly sent back, since the fire detector operates through the transmission ①, the transmission is fixed to the transmission ① in Step 21A. In Step S6, this address is indicated at the indicator section 8. In other words, the three LEDs 45 of the operation display section 36 of FIG. 4 which correspond to the numbers of the address are lit. In the same way, if, in Step S4B, the address has been properly sent back, since the fire detector operates based on the transmission ②, the transmission is fixed to the transmission ②, in Step S21B. In Step S6, the address is indicated by the indicator section 8. That is, three LEDs 45 of the operation indicator section 36 of FIG. 4 which correspond to the numbers of the address are lit.

In Step S7, the microcomputer 5 determines whether or not there has been an input of the address to be set. This address input is performed as described above.

If, in Step S7, there has not been an input of the setting address, then, the process returns back to Step S3A to repeat the above-described operations. If there has been an input, then the process proceeds to Step S8 to execute the setting. In other words, the microcomputer 5 determines whether or not execution key 38 of FIG. 4 has been pressed.

If the execution key 38 has not been pressed, the device waits for the execution key 38 to be pressed, with the setting address indicated by the indicator section. If the execution key 38 has been pressed, the address setting is completed. The LEDs 45 which have been blinking until this time are now lit, so that the three LEDs 45 which correspond to the numbers of the address input at this point are lit.

In Step S9, the set address is transmitted along with address setting command, etc. to the corresponding fire detector to change the address stored in an internally provided storage means, for example, an EEPROM. In Step S10, this address, which has been changed and set, is sent back again for confirmation.

In Step S11, the microcomputer 5 determines whether or not the address which has been sent back from the fire detector matches the address set at the address confirming device. If they do match each other, the process returns back to Step S3A to prepare for the setting of the next fire detector.

If, in Step S11, the addresses do not match each other, in Step S12, an occurrence of a setting error is indicated by the indicator section 8. In other words, the LED 44 of the operation indicator section 36 of FIG. 4 is lit. Thereafter, the process returns back to Step S3A and preparation is made for the fire detector to be connected properly or for it to be replaced with a new one.

In Step S1, pressing, for example, the power key 37 of FIG. 4 alone causes the operation mode to be set in confirmation mode. In accordance with the fire detector to be set under the control of microcomputer 5, the switches 12 and 13 switch to either the transmission circuit 10 side or transmission circuit 11 side, and the switch 14 closes, causing the power to be turned on. In Step S2, the microcomputer 5 determines whether the mode is address setting mode or confirmation mode. In this case, the mode is confirmation mode, so that as in the above-described Steps 3A through S6, first, in Step S13A of FIG. 8, by way of the transmission 1 transmission for address searching is started. A command is generated to cause the fire detector to send its address. This address is received by the microcomputer 5.

In Step S14A, the microcomputer 5 determines whether or not the address has been sent back properly. If it has not been sent back properly, then, in Step S13B, by way of the transmission ② transmission for address searching is started. A command is generated to cause the fire detector to sends its address. This address is received by the microcomputer 5.

In Step S14B, the microcomputer 5 determines whether or not the address has been sent back properly. If it has not been sent back properly, then, in Step S15, a transmission error is indicated by the indicator section 8. In other words, the LED 44 of the operation indicator section 36 of FIG. 4 is lit. Then, the process returns back to Step S13A.

If, in Step S14A, the address is that of the fire detector, then, in Step S24A, transmission is fixed to the transmission ①. If, in Step S14B, the address is that of another fire detector, then, in Step S24B, the transmission is fixed to the transmission ②. Thereafter, in either case, in Step S16, the address is indicated by the indicator section 8. In other words, three LEDs 45 of the operation indicator section 36 of FIG. 4 which correspond with the numbers of the address are lit. Then, the process returns back to Step S13A where preparation is made for the confirmation of the next fire detector.

Accordingly, performing the operations in accordance with the above-described calling selecting method and sending out calling commands, in a plurality of transmission modes, allow confirmation of the transmission mode of the terminal device responding to the command and automatic selection of the transmission mode. Therefore, even if the transmission mode of the fire detector is not known, it is possible to carry out address setting and confirmation.

Figure 9:
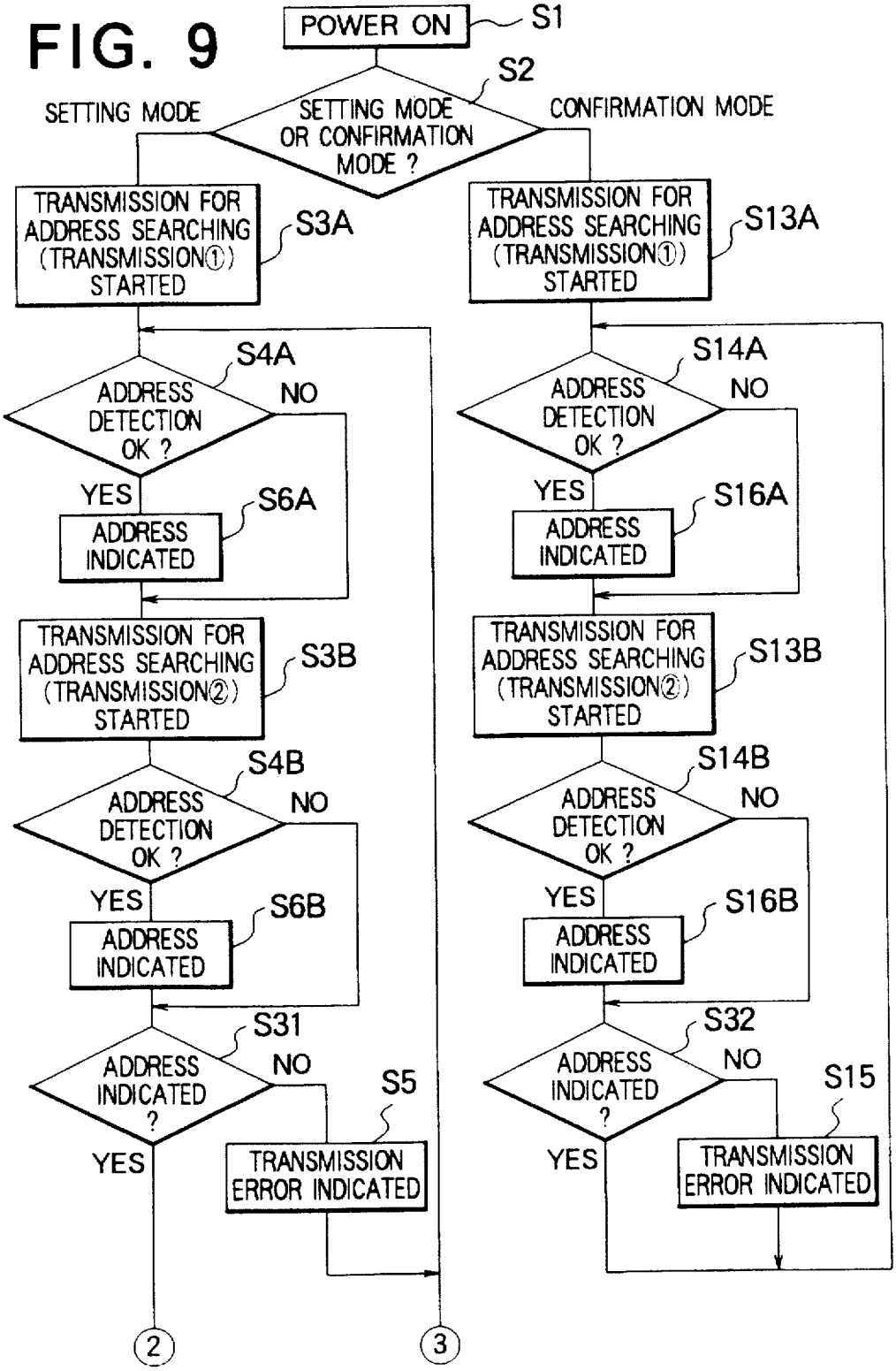
FIG. 9 is a flowchart for describing the operational steps to be performed (all-signal transmitting method) when the transmission modes of fire detectors or the like in an embodiment of the invention are different.
Figure 10:
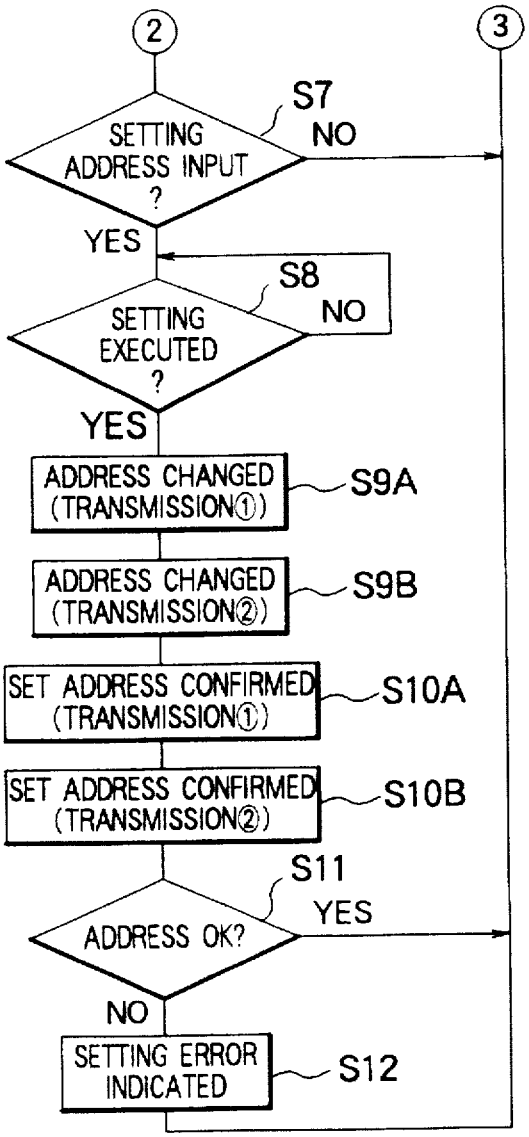
FIG. 10 is a flowchart for describing the operational steps to be performed (all-signal transmitting method) when the transmission modes of fire detectors or the like in an embodiment of the invention are different.

A description will be made of the all-signal sending method, with reference to FIGS. 9 and 10. Here, all determinations are made in the microcomputer 5. In FIGS. 9 and 10, the steps which are the same as those of FIG. 5 are given the same reference numerals. Transmission ① represents transmission using the transmission circuit 10, while transmission ② represents transmission using the transmission circuit 11.

In Step S1 of FIG. 9, pressing, for example, the digit key 39 and power key 37 of FIG. 4 simultaneously causes the operation mode to be set in setting mode. In correspondence with the fire detector to be set under the control of microcomputer 5, the switches 12 and 13 switch to either transmission circuit 10 side or transmission circuit 11 side, and the switch 14 is closed, causing the power to be turned on. In Step S2, the microcomputer 5 determines whether the mode is address setting mode or confirmation mode. In this case, the mode is setting mode, so that, in Step S3A, by way of the transmission ① the transmission for address searching is started. A command is generated to cause the fire detector to send its address. The address is received by the microcomputer 5.

In Step S4A, the microcomputer 5 determines whether or not the address has been sent back properly. If it has been sent back properly, then, in Step S6A, this address is indicated by the indicator section 8. That is, three LEDs 45 of the operation indicator section 36 of FIG. 4 which correspond to the numbers of the address are lit. Thereafter, or if the address which has been sent back in Step S4A is not that of the fire detector, in Step S3B, by way of the transmission ② transmission for address searching is started. A command is generated to cause the fire detector to send its self address. This address is received by the microcomputer 5.

In Step S4B, the microcomputer 5 determines whether or not the address has been properly sent back. If it has been properly sent back, in Step S6B, the address is indicated by the indicator section 8. That is, three LEDs 45 of the operation indicator section 36 of FIG. 4 which correspond to the numbers of the address are lit. Thereafter, or if the address which has been sent back in Step S4B is not that of the fire detector, in Step S31, the microcomputer 5 determines whether or not there has been an address indication. If there has not been an address indication, then, in Step S5, an occurrence of a transmission error is indicated by the indicator section 8. That is, the LED 44 of the operation indicator section 36 of FIG. 4 is lit. Thereafter, the process returns back to Step S4A and the address confirming device waits for the fire detector to be connected properly or for it to be replaced by a good one.

If there has been an address indication in Step S31, then, in Step S7 of FIG. 10, the microcomputer 5 determines whether or not the address to be set has been input. The address is input as described above.

If the setting address has not been input in Step S7, the process returns back to Step S4A and the above-described operations are repeated. If it has been input, the process proceeds to Step S8 and the microcomputer 5 determines whether or not the setting has been executed, that is whether or not the execution key 38 of FIG. 4 has been pressed.

If the execution key 38 has not been pressed, the address confirming device waits for the execution key 38 to be pressed, with the setting address indicated by the indicator section. If the execution key 38 has been pressed, the address setting is completed. The LEDs 45 which have been blinking up to this time are now lit. This means that three LEDs 45 which correspond to the numbers of the address which have been input are now lit.

In Step S9A, the set address along with the address setting command, etc. are transmitted to the corresponding fire detector by way of the transmission ① to change the address which is stored in an internally provided storage means, for example, an EEPROM. In the same way, in Step S9B, the address to be set is transmitted along with the address setting commands, etc. to the corresponding fire detector by way of the transmission ② to change the address stored in an internally provided storage means, for example, an EEPROM. In Step S10A, the address which has been changed and set is sent back by way of the transmission ① for confirmation. In the same way in Step S10, the address which has been changed and set is sent back again by way of the transmission ② for confirmation.

In Step S11, the microcomputer 5 determines whether or not the address which has been sent back matches that set at the device as described above. If they do match each other, the process returns back to Step S4A and the device prepares for the setting of the next fire detector. If they do not match each other in Step S11, then, in Step S12, an occurrence of a setting error is indicated by the indicator section 8. That is, the LED 44 of the operation indicator section 36 of FIG. 4 is lit. Thereafter, the process returns back to Step S4A and the device waits for the fire detector to be connected properly or for it to be replaced by a good one.

In Step S1, pressing, for example, the power key 37 of FIG. 4 alone causes the operation mode to be set in confirmation mode. In correspondence with the fire detector to be set under the control of microcomputer 5, the switches 12 and 13 switch to either transmission circuit 10 side or transmission circuit 11 side, and the switch 14 is closed, causing the power to be turned on. In Step S2, the microcomputer 5 determines whether the mode is address setting mode or confirmation mode. In this case, the mode is confirmation mode, so that, as described above, in Step S13A of FIG. 9, by way of the transmission ①, transmission for address searching is started. A command is generated to cause the fire detector to send its address. This address is received by the microcomputer 5.

In Step S14A, the microcomputer 5 determines whether or not the address has been properly sent back. If it has been properly sent back, then, in Step S16A, this address is indicated by the indicator section 8. That is, the three LEDs 45 of operation indicator section 36 of FIG. 4 which correspond to the numbers of the address are lit. Thereafter, or if the address which has been sent back in Step S14A is not that of the fire detector, in Step S13B, by way of the transmission ②, transmission for address searching is started. A command is generated to cause the fire detector to send its address. This address is received by the microcomputer 5.

In Step S14B, the microcomputer 5 determines whether or not the address has been properly sent back. If it has been properly sent back, then, in Step S16B, this address is indicated by the indicator section 8. That is, the three LEDs 45 of the operation indicator section 36 of FIG. 4 which correspond to the numbers of the address are lit. Thereafter, or if the address that has been sent back in Step S14B is not that of the fire detector, in Step S32, the microcomputer 5 determines whether or not the address has been indicated. If it has not been indicated, then, in Step S15, an occurrence of a transmission error is indicated by the indicator section 8. That is, the LED 44 of the operation indicator section 36 of FIG. 4 is lit. Thereafter, when the operation in Step S15 has been completed, or, if the address has been indicated in Step S32, the process returns back to Step S14A and the device prepares for the confirmation of the next fire detector.

Accordingly, by processing carried out in accordance with the all-signal sending method, using all of the transmission modes when calling commands or the like are sent out it is not necessary to select the transmission mode, so that incorrect selection of transmission modes will not occur.

In this embodiment, switching the transmission mode with a change-over switch allows use of a fire detector serving as a terminal device having different transmission modes to be used by matching the modes, so that sending out calling commands, in a plurality of modes, allows confirmation of the transmission mode of the terminal device responding to the command and automatic selection of the transmission mode. Even if the transmission mode of the fire detector is not known, it is possible to perform address setting and confirmation. Using all the transmission mode commands when calling commands or the like are sent out makes it unnecessary to select the transmission mode, which eliminates the problem of erroneous transmission mode selection. Therefore, even when, in particular, the external appearances of terminal devices are the same, it is possible to immediately perform address setting and confirmation of each terminal device, such as a fire detector, without delay.

Even in this case, upon completion of address setting and confirmation of a fire detector by the use of the above-described setting mode, the device is allowed to wait at the time the address is checked (Step S4, etc.), so that it can prepare for the address setting and confirmation of the next fire detector. Therefore, a user who is not experienced or skilled in handling the fire detector does not need to turn on the power of the device 30 each time the fire detector is replaced. This allows him to set and confirm the address of the fire detector efficiently and accurately.

Upon completion of address setting and confirmation of a fire detector by the use of the above-described setting mode, the device is allowed to wait at Step S14A, so that it can prepare for the address setting and confirmation of the next fire detector. Therefore, even if the user is not experienced or skilled in handling the fire detector or the like, he does not have to turn on the power of the device 30 each time the fire detector is replaced. This allows him to confirm the address of the fire detector efficiently and accurately. In addition, in this case the unexperienced user cannot carelessly change the address which has already been set, so that it is safe from the viewpoint of fire detector control.

In the above-described embodiment, switch 14 functions as an auto-power off switch which automatically turns off under the control of microcomputer 5 after a predetermined time has elapsed.

In addition, in the above-described embodiment, a description has been made when the address is indicated by three digits; however, the invention is not limited thereto and the address may be indicated by any number of digits. In this case, the invention is applicable in the same way.

Further, in the above-described embodiment, a description has been made when the address of a fire detector serving as a terminal device is indicated. However, the invention is applicable in the case when other information regarding the terminal device, for example, the different types of fire detectors are indicated. In this case, the same effects are produced.

What is claimed is:

1. A setting device for a fire alarm system comprising:

a terminal device connecting section for removably connecting with and contacting a terminal device of the fire alarm system;

control means, connected to said terminal device connecting section, for generating an information-requesting command to the terminal device and receiving information from the terminal device in response to the information-requesting command;

an indicator section connected to said control means for indicating the information received from the terminal device by said control means; and transmission means, connected to said control means, for transmitting information signals to and from the terminal device;

wherein said setting device supplies power and transmits the information-requesting command to the terminal device through said transmission means and said terminal device connecting section.

2. The setting device for a fire alarm system as set forth in claim 1, further comprising:

an operation section connected to said control means for inputting desired information of the terminal device, wherein said control means generates a command to the terminal device in accordance with the desired information from said operation section.

3. The setting device for a fire alarm system as set forth in claim 2, wherein: said control means determines which one of a plurality of modes said setting device is in upon start-up of the setting device, and said plurality of modes include a confirmation mode in which said indicator section indicates information received from the terminal device and a setting mode in which a setting command is sent to set information, input from said operation section, at the terminal device.

4. The setting device for a fire alarm system as set forth in claim 1, wherein said transmission means comprises a plurality of transmission circuits and said control means can select one of said plurality of transmission circuits in accordance with various transmission modes of the terminal device.

5. The setting device for a fire alarm system as set forth in claim 1, wherein: said control means generates call commands of a plurality of transmission modes to the terminal device in succession; and further transmissions are based on a response of the terminal device to one of said plurality of transmission modes.

6. The setting device for a fire alarm system as set forth in claim 1, wherein: said control means generates all call commands to the terminal device to perform time sharing transmissions based on all transmission modes of said setting device.

7. The setting device for a fire alarm system as set forth in claim 1, wherein: said indicator section has a plurality of indicating elements corresponding to digits to be indicated; information regarding the terminal device is indicated by said indicating elements and one of said plurality of indicating elements is lit for each digit.

8. The setting device for a fire alarm system as set forth in claim 1, wherein:

the information received by said control means from the terminal device is an address of the terminal device.

9. A setting device for a fire alarm system, comprising:

a terminal device connecting section having a first base removably and electrically connectable to a first terminal device of a first size, and a second base removably and electrically connectable to a second terminal device of a second size which is smaller than the first size; and said second base is recessed within said first base.

10. A setting device for a fire alarm system comprising:

a terminal device connecting section removably connectable to a terminal device of the fire alarm system for supplying power and transmitting information signals to the terminal device;

control means, connected to said terminal device connecting section, for transmitting information-requesting commands to the terminal device and receiving information set in the terminal device;

an indicator section connected to said control means for indicating the information received from the terminal device by said control means; and a plurality of transmission circuits for transmitting information signals to the terminal device;

wherein said control means is connected to said terminal device connecting section through said transmission circuits and said control means can select one of said plurality of transmission circuits in accordance with various transmission modes of the terminal device.

11. The setting device for a fire alarm system as set forth in claim 10, wherein:

the information received by said control means from the terminal device is an address of the terminal device.

12. A fire alarm system comprising:

a fire alarm terminal device; and a setting device comprising a terminal device connecting section for removably connecting and contacting said fire alarm terminal device;

control means, connected to said terminal device connecting section, for generating an information-requesting command to said fire alarm terminal device and receiving information from said fire alarm terminal device in response to the information-requesting command;

an indicator section connected to said control means for indicating the information received from said fire alarm terminal device by said control means; and transmission means, connected to said control means, for transmitting information signals to and from said terminal device;

wherein said setting device supplies power and transmits the information-requesting command to said fire alarm terminal device through said transmission means and said terminal device connecting section.

13. A portable setting device for a fire alarm system and being capable of being connected to a terminal device, said portable setting device comprising:

a housing;

a terminal device connecting section formed on said housing;

a microcomputer located in said housing and connected to said terminal device connecting section;

an operation section and an indicator section, located on said housing and connected to said microcomputer; and a means for providing power to said setting device and for providing power to a terminal device when said terminal device is connected to said setting device through said terminal device connecting section, connected to said microcomputer;

wherein said microcomputer is connected to said terminal device connecting section through one of a plurality of transmission circuits; and a transmission circuit change-over switch is provided between said microcomputer and said plurality of transmission circuits.

14. The portable setting device as set forth in claim 13, wherein said terminal device connecting section includes a first base and a second base which is smaller than said first base.

15. The portable setting device as set forth in claim 13, wherein said operation section includes push button keys and said indicator section includes LEDs.

* * * * *